United States Patent [19]

Logie

[11] Patent Number: 4,716,393

[45] Date of Patent: Dec. 29, 1987

[54] ELECTROMAGNETIC ACTUATOR

[75] Inventor: Frank M. Logie, London, England

[73] Assignee: Lucas Industries public limited company, Birmingham, England

[21] Appl. No.: 886,564

[22] Filed: May 22, 1986

[30] Foreign Application Priority Data

Jun. 8, 1985 [GB] United Kingdom ..... 8514544

[51] Int. Cl.[4] ..... H01F 7/08

[52] U.S. Cl. ..... 335/261; 335/281; 335/266

[58] Field of Search ..... 335/255, 261, 270, 279, 335/281, 266

[56] References Cited

U.S. PATENT DOCUMENTS 2,992,304 7/1961 Andrews ..... 335/261

4,438,420 3/1984 Leiber et al. ..... 335/261 X

FOREIGN PATENT DOCUMENTS 2458516 6/1976 Fed. Rep. of Germany ..... 335/261

*Primary Examiner*—George Harris

*Attorney, Agent, or Firm*—Balogh, Osann, Kramer, Dvorak, Genova & Traub

[57] ABSTRACT

An electromagnetic actuator includes a core structure defining a central pole piece and an annular pole piece surrounding the central pole piece in spaced relationship. A winding is provided which when energized causes the pole faces of the pole pieces to assume opposite magnetic polarity to draw an armature towards the pole faces. A further winding is located about the annular pole piece and an annular core component surrounds the annular pole piece in spaced relationship and extends beyond the pole faces to form a radial air gap 23 with the armature.

2 Claims, 2 Drawing Figures

ELECTROMAGNETIC ACTUATOR

This invention relates to electromagnetic actuators of the kind comprising a core structure having a central pole piece defining a pole face, at least one annular pole piece surrounding the central pole in spaced relationship and defining an annular pole face, each pole piece having an annular recess defined between it and the adjacent pole piece, an electrical winding or windings located in the recess or recesses respectively, said winding or windings when energised causing adjacent pole faces to assume opposite magnetic polarity and an armature formed from magnetic material, said armature when said winding or windings are energised, being attracted towards said pole faces.

An example of such an actuator is disclosed in the specification of British Pat. No. 1599525. In the examples described in this specification the armature forms part of a fuel flow control valve in a fuel system for an internal combustion engine.

For a given magnetic flux density in the pole pieces, the outer or outermost pole piece can have a reduced radial width as compared with the inner pole or pole pieces. However, because the circumferential length of the outer or outermost pole pieces is high, the force efficiency of the outer or outermost pole pieces is low because of the high leakage flux. Moreover, as the number of pole pieces is increased to increase the force which can be developed by the actuator, the diameter of the armature increases and problems can arise due to a lack of rigidity in the armature. A further disadvantage is the fact that non-magnetic materials must be used around the perimeter of the core structure in order to minimise the flux leakage.

The object of the invention is to provide an actuator of the kind specified in an improved form.

According to the invention an actuator of the kind specified comprises a further winding surrounding the outer pole piece, an annular core component extending alongside but spaced from the outer pole piece by a recess containing the further winding, said core component extending beyond said pole faces and defining a radial air gap with the armature.

An example of an actuator in accordance with the invention will now be described with reference to the accompanying drawings, in which.

Figure 1:
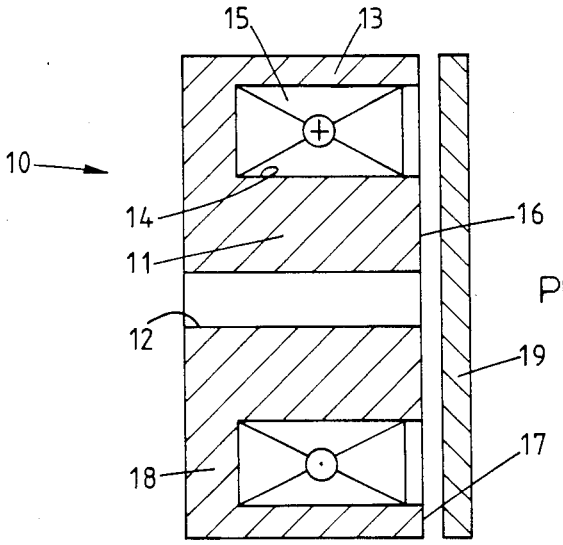
PRIOR ART FIG.1.
FIG. 1 shows a diagrammatic form of a known actuator.

Referring to FIG. 1 of the drawings the known form of actuator comprises a core structure generally indicated at 10 having a central cylindrical pole piece 11 which in the particular example, is provided with a central bore 12. The core structure also includes an annular pole piece 13 surrounding the central pole piece in spaced relationship. Defined between the pole pieces is an annular recess 14 in which is wound an electrical winding 15. The central pole piece defines a pole face 16 and the outer pole piece defines a pole face 17, the two pole faces lying in a common plane. At their ends remote from the pole faces, the pole pieces are magnetically connected by a yoke 18. The actuator also includes an armature 19 formed from magnetic material of plate-like form.

When the winding 15 is energised the pole faces 16 and 17 assume opposite magnetic polarity and the flux crosses the air gaps between the pole faces and the armature resulting in an attraction force acting upon the armature to urge the armature towards the pole faces. It will be noted that the radial width of the outer pole face 17 and also the pole piece 13, is reduced as compared with that of the pole face 16 and the central pole piece 11. This is because the circumferential length of the outer pole piece is substantially longer than that of the central pole piece but it has the same cross-sectional area as the central pole piece. The example of FIG. 1 has only one winding but further annular pole pieces may be provided with additional windings in the recesses defined between adjacent pole pieces so as to provide an increased force on the armature. As explained, the efficiency of the outer pole piece and its pole face is reduced because of flux leakage.

Figure 2:
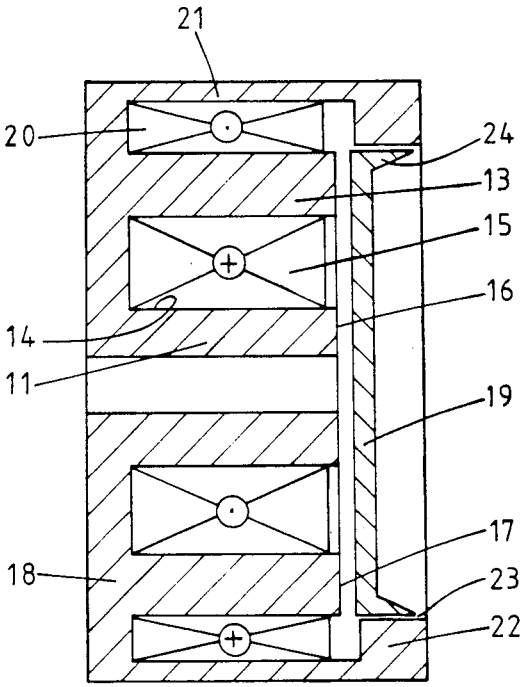
FIG. 2 shows in similar form an actuator in accordance with the invention.

Turning now to the actuator shown in FIG. 2, the components which are similar to those of the actuator shown in FIG. 1 have been assigned the same reference numerals but in this case the actuator has a further winding 20 surrounding the outer pole piece 13 and the core structure defines an annular core component 21 which extends from the yoke alongside but spaced from the pole piece 13. In addition, the core component extends beyong the pole faces 16, 17 and includes an annular inwardly extending portion 22 which defines a radial air gap 23 with the armature the latter being provided with an axially extending peripheral extension 24. It will also be noted that the radial width of the outer pole piece 13 is increased as compared with that of the actuator shown in FIG. 1.

The winding 20 is energised at the same time as the winding 15 but the direction of current flow or the direction of winding is opposite to that of the winding 15 so that the winding 20 contributes to the flux flowing in the outer pole piece 13. The flux flowing in the core component 21 is directed into the armature by way of the air gap 23 and the result is that the force which can be exerted on the armature is increased. The increase in force is obtained without any substantial increase in the diameter of the armature so that the rigidity of the armature is substantially the same. Moreover, the magnetic flux is substantially confined within the magnetic circuit of the actuator and the core structure can be contained or mounted within a mounting formed, if desired, from magnetic material.

I claim:

1. An electromagnetic actuator comprising a core structure having a central pole piece defining a pole face, at least one annular pole piece surrounding the central pole piece in spaced relationship and defining an annular pole face, said spaced relationship between said central pole piece and said annular pole piece defining an annular recess, at least one electric winding located in the annular recess, said winding, when energized, causing adjacent pole faces to assume opposite magnetic polarity, an armature formed from magnetic material, said armature, when said winding is energized, being attracted towards said pole faces, an annular core component extending alongside but spaced from the outer pole piece by a recess containing at least one further winding, said core component extending beyond said pole faces and defining a radial air gap with the armature.

2. An actuator according to claim 1 in which the armature has a diameter substantially equal to the outside diameter of the pole face of the outer pole piece and said core component includes an annular inwardly extending portion which defines said radial air gap with the armature.

* * * * *

UNITED STATES PATENT AND TRADEMARK OFFICE

CERTIFICATE OF CORRECTION

PATENT NO. : 4,716,393

DATED : December 29, 1987

INVENTOR(S) : Frank M. LOGIE

It is certified that error appears in the above-identified patent and that said Letters Patent are hereby corrected as shown below:

On the Title Page, Item [21]

The Application No.: "886,564" should be changed to --866,564--.

Signed and Sealed this

Twentieth Day of September, 1988

*Attest:*

*Attesting Officer*

DONALD J. QUIGG

*Commissioner of Patents and Trademarks*